US010975475B2

(12) United States Patent
Kaneko et al.

(10) Patent No.: US 10,975,475 B2
(45) Date of Patent: Apr. 13, 2021

(54) ELECTROLESS GOLD PLATING BATH

(71) Applicant: C. Uyemura & Co., Ltd., Osaka (JP)

(72) Inventors: Yohei Kaneko, Osaka (JP); Naoshi Nishimura, Osaka (JP); Tsuyoshi Maeda, Osaka (JP); Katsuhisa Tanabe, Osaka (JP)

(73) Assignee: C. UYEMURA & CO., LTD., Osaka (JP)

( * ) Notice: Subject to any disclaimer, the term of this patent is extended or adjusted under 35 U.S.C. 154(b) by 0 days.

(21) Appl. No.: 16/806,328

(22) Filed: Mar. 2, 2020

(65) Prior Publication Data

US 2020/0283906 A1 Sep. 10, 2020

(30) Foreign Application Priority Data

Mar. 6, 2019 (JP) ..... JP2019-040385

(51) Int. Cl.
*C23C 18/44* (2006.01)

(52) U.S. Cl.
CPC ..... *C23C 18/44* (2013.01)

(58) Field of Classification Search
None
See application file for complete search history.

(56) References Cited

U.S. PATENT DOCUMENTS 3,635,761 A * 1/1972 Haag ..... C23C 18/44 427/99.5
4,009,297 A * 2/1977 Redmond ..... C23C 18/44 427/558
4,714,627 A * 12/1987 Puddephatt ..... C23C 16/18 427/124
5,202,151 A * 4/1993 Ushio ..... C23C 18/44 427/304
5,679,237 A * 10/1997 Chamard ..... B01J 31/24 205/420
5,803,957 A * 9/1998 Murakami ..... C23C 18/44 106/1.13
6,183,545 B1 * 2/2001 Okuhama ..... C22B 3/0051 106/1.18
7,641,944 B2 * 1/2010 Ichimura ..... C23C 18/143 427/553
2008/0138507 A1 6/2008 Kiso et al.
2008/0277140 A1 11/2008 Kurosaka et al.
2009/0159453 A1 * 6/2009 Yoshimoto ..... C25D 5/34 205/263
2014/0054788 A1 * 2/2014 Majima ..... H01L 21/76838 257/773
2014/0072822 A1 * 3/2014 Kojima ..... C08F 12/30 428/553
2014/0072882 A1 * 3/2014 Zhou ..... C08G 77/50 429/313
2017/0335113 A1 * 11/2017 Kim ..... C09D 1/00
2019/0085461 A1 * 3/2019 Schafer ..... C23C 18/40
2020/0232099 A1 * 7/2020 Spreemann ..... C23C 18/44

FOREIGN PATENT DOCUMENTS

CN 101348927 A * 1/2009
EP 2698448 A1 * 2/2014
JP 2005/290415 A * 10/2005
JP 2008-144188 6/2008
JP 2008-266668 11/2008
WO 2016/174780 11/2016
WO 2017/050662 3/2017

OTHER PUBLICATIONS

EPO Search Report for EP 20160648 dated Jul. 14, 2020; 2 pages.*
English translation of WO 2016/174780, Nov. 2016; 28 pages.*
English translation of JP 2005/290415, Oct. 2005; 11 pages.*
English translation of CN 101348927, Jan. 2009; 5 pages.*

* cited by examiner

*Primary Examiner* — Helene Klemanski
(74) *Attorney, Agent, or Firm* — Wenderoth, Lind & Ponack, L.L.P.

(57) ABSTRACT

The present invention provides an electroless gold plating bath having excellent plating bath stability without containing a cyanide compound under long term plating bath heating time. An electroless gold plating bath of the present invention solving above problems includes: a water-soluble gold salt; a reducing agent; and a phosphine compound represented by a following formula (1)

(1)

wherein $R_1$, $R_2$, and $R_3$ represent identically or differently either a phenyl group, or an alkyl group having 1 to 5 carbons, and at least one of the phenyl group or the alkyl group is substituted by a sulfonate group or its salt, a cyano group, or a carboxy group or its salt.

5 Claims, 1 Drawing Sheet

A
corrosion
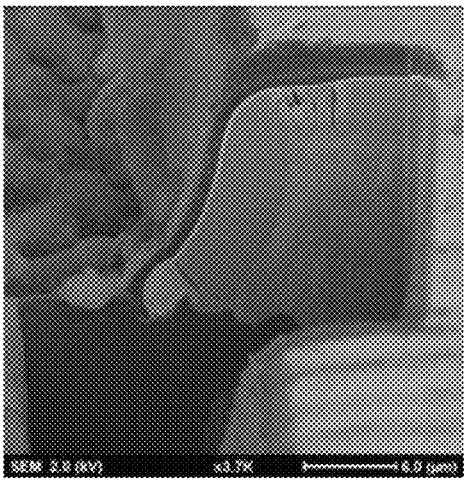
B
no corrosion
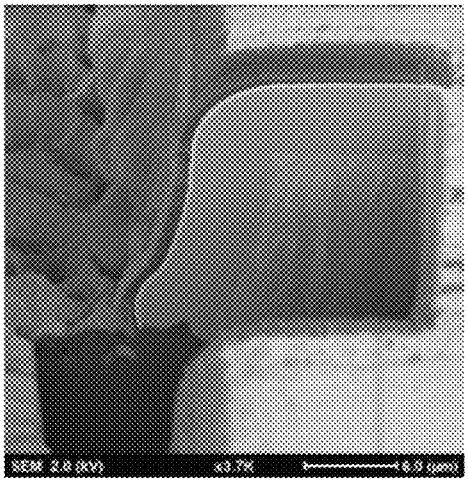

ELECTROLESS GOLD PLATING BATH

CROSS-REFERENCE TO RELATED APPLICATIONS

This application is related to and claims priority under 35 U.S.C. 119 to Japanese Patent Application No. 2019-040385, filed on Mar. 6, 2019, incorporated herein by reference in its entirety.

TECHNICAL FIELD

The present invention relates to an electroless gold plating bath.

BACKGROUND ART

Gold plating is widely used in component mounting processes such as printed circuit boards and electronic components as a surface treatment method for raising reliability. Conventionally well know electroless plating methods for gold plating film include a displacement gold plating method and a gold plating method of combination of displacement and reduction known as a mixed reaction gold plating method. The displacement gold plating method allows gold to deposit on an underlying metal layer by difference in oxidation-reduction potential between underlying metal such as nickel and a plating bath. However, this method have drawbacks such as limiting the types of underlying metal to be applied or resulting in difficulty to increase the gold plating film thickness because displacement reaction allows gold to oxidize or dissolve the underlying metal which resulted in corrosion of the underlying metal. The displacement gold plating method have another drawbacks such as lowering a wire bonding state because this method diffuses the underlying metal to a surface of gold plating film.

With regard to the mixed reaction gold plating method, the methods promote displacement reaction and reduction reaction concurrently in one plating bath containing a reducing agent. Examples of the mixed reaction gold plating include Electroless Nickel/Immersion Gold (ENIG) having constitution of displacement gold plating film on underlying electroless nickel plating film, Electroless Nickel/Electroless Palladium/Immersion Gold (ENEPIG) having constitution of electroless palladium plating film between underlying electroless nickel plating film and displacement gold plating film, Electroless palladium/displacement gold having constitution of displacement gold plating film on electroless palladium film, Direct Immersion Gold (DIG) having constitution of displacement gold plating film formed directly on copper film. The mixed reaction gold plating method allows to eliminate the corrosion of the underlying metal by the displacement gold plating method and to obtain gold plating film with high coatability. In addition, this method have made possible to form thicker gold plating film allowing the gold plating film to use for solder bonding and wire bonding.

The mixed reaction gold plating method known for reducing underlying layer corrosion are exemplified in Patent Document 1 and Patent Document 2 listed below. Patent Document 1 discloses a reducing agent containing formaldehyde and/or formaldehyde bisulfite adduct, and a predetermined amine compound. Patent Document 2 discloses a reducing agent containing an aldehyde compound and a predetermined amine compound.

Patent Document 3 discloses that "the above-mentioned Patent Document 2 has poor bath stability, and gold is deposited and decomposed in a bath with few hours of heating". Patent Document 3 discloses a method for stably maintaining gold solubility in gold plating solution by supplying a cyanide compound such as sodium cyanide during heating of electroless gold plating solution. Patent Document 4, same as Patent Document 3, discloses to add a cyanide compound ion source such as sodium cyanide as a stabilizer.

PRIOR ART DOCUMENT

Patent Document

[Patent Document 1] JP2008-266668A1
[Patent Document 2] JP2008-144188A1
[Patent Document 3] WO2016/174780A1
[Patent Document 4] WO2017/050662A1

SUMMARY OF THE INVENTION

Technical Problem

However, Patent Document 3 and Patent Document 4 require to take strict safety management for securing work environment during plating process due to the use of highly toxic cyanide compounds. Therefore, it is desired a gold plating bath capable of preventing decomposition of a plating bath without using a cyanide compound.

The present invention has been made in view of the above issues, and an object of the present invention is to provide an electroless gold plating bath having excellent plating bath stability, which can prevent decomposition of a plating bath by deposition of gold, without containing a cyanide compound even under long term plating bath heating time.

Solution to the Problem

[1] An electroless gold plating bath of the present invention solving above problems includes:
a water-soluble gold salt;
a reducing agent; and
a phosphine compound represented by a following formula (1)

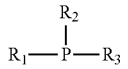

(1)

wherein $R_1$, $R_2$, and $R_3$ represent identically or differently either a phenyl group, or an alkyl group having 1 to 5 carbons, and at least one of the phenyl group or the alkyl group is substituted by a sulfonate group or its salt, a cyano group, or a carboxy group or its salt.

[2] The electroless gold plating bath according to above [1], wherein the electroless gold plating bath contains no cyanide compound as an additive.

Advantageous Effects of the Invention

The present invention provides an electroless gold plating bath having excellent plating bath stability, which can prevent decomposition of a plating bath by deposition of gold, without containing a cyanide compound even under long term plating bath heating.

BRIEF DESCRIPTION OF THE DRAWINGS

The figure shows SEM (Scanning Electron Microscope) observation photographs showing the presence of corrosion or the absence of corrosion on a nickel plating surface. The photograph showing the corrosion is taken from No. 16 in table 1 and the photograph showing no corrosion is taken from No. 1 in Table 1.

DESCRIPTION OF EMBODIMENTS

The present inventors studied intensively various compositions of gold plating baths. The studies lead the inventers to the present invention that a gold plating bath containing a specified phosphine compound as a stabilizer achieves above purpose.

(1) Phosphine Compound

Firstly, the phosphine compound of the above formula that most characterizes the present invention is explained below.

Basic experiments by the present inventors have resulted in selecting the above phosphine compound from various water-soluble phosphine compounds as a stabilizer allowing to prevent decomposition of gold even under long term plating bath heating. Addition of the phosphine compound results in maintaining an acceptable plating deposition rate with suppressing plating bath decomposition without supplying a cyanide compound to a plating bath during plating bath heating even under longer term such as heating a plating bash at 80° C. for 5 days as shown in Example 2 described later (see Table 5 below).

In the above formula, at least one selected from the group of the phosphine compound and the alkyl group having 1 to 5 carbons constituting $R_1$, $R_2$ and $R_3$ is substituted by a substituent group of selected from a sulfonate group or a salt thereof, a cyano group, or a carboxy group or a salt thereof. Examples of the "salt" include alkali metal salts such as sodium salt and potassium salt; amine salts such as triethylamine salt; hydrochloride salt and other salts like these. At least one selected from the group of $R_1$, $R_2$, and $R_3$ of the phosphine compound of the present invention requires to be substituted and two or all three selected from the group of $R_1$, $R_2$, and $R_3$ of the formula may be substituted. The phosphine compound may have a hydrate form.

The present invention excludes phosphine compounds, which exhibit no water-solubility, having no substituent in above $R_1$, $R_2$ and $R_3$ of the formula and composed only of a phenyl group or an alkyl group having 1 to 5 carbons.

Also, the present invention excludes phosphine compounds having substituents other than those described above as a present invention. As exemplified phosphine compounds excluded from the present invention include phosphine compounds having $R_1$, $R_2$, and $R_3$ represented by lower alkyl groups, and at least one selected from the group of $R_1$, $R_2$, and $R_3$ is substituted by a hydroxy group or an amino group which is different substituents from the substituents of the present invention defined as a sulfonate group or its salt, a cyano group, or a carboxy group or its salt. As exemplified in comparative example 18 below, the plating bath containing tris (3-hydroxypropyl) phosphine resulted in poor effect (see Table 5 below).

In the above formula, the alkyl group having 1 to 5 carbons may be linear, branched or cyclic and examples include a methyl group, a ethyl group, a propyl group, an isopropyl group, a cyclopropyl group, a butyl group, a sec-butyl group, a tert-butyl group, and a pentyl group. Among these examples, an alkyl group having 1 to 3 carbons is preferable, and a methyl group, an ethyl group, a propyl group, and an isopropyl group are preferable.

In the above formula, the phenyl group and the alkyl group having 1 to 5 carbons are preferably substituted with the same substituent with each other. Or the phenyl group is preferably substituted with a sulfonic acid group, and the alkyl group is preferably substituted with a carboxy group or a salt thereof.

Examples of the phosphine compound used in the present invention include sodium triphenylphosphine-3-sulfonate, dipotassium bis (p-sulfonatophenyl) phenylphosphine dihydrate, triphenylphosphine-3,3',3"-trisothum trisulfonate, di (t-butyl) (3-sulfonatopropyl) phosphine, (2-cyanophenyl) diphenylphosphine, tris (2-cyanoethyl) phosphine, tris (2-carboxyethyl) phosphine hydrochloride, etc. Among examples preferably are sodium triphenylphosphine-3-sulfonate, triphenylphosphine-3,3',3"-trisothum trisulfonate, tris (2-cyanoethyl) phosphine, tris (2-carboxyethyl) phosphine. Commercially available products may be used as the phosphine compound of the present invention.

The concentration of the phosphine compound in the electroless gold plating bath of the present invention ranges preferably from 0.0001 to 1 mmol/L, and more preferably from 0.001 to 0.1 mmol/L.

(2) Water-Soluble Gold Salt

The electroless gold plating bath of the present invention contains a water-soluble gold salt as a gold source. Specific examples of the water-soluble gold salt include gold cyanide, gold cyanide salts such as potassium gold cyanide, sodium gold cyanide, ammonium gold cyanide; gold sulfite, gold thiosulfate, gold thiocyanate, gold sulfate, gold nitrate, gold methane sulfonate, gold tetraammine complex, gold chloride, gold bromide, gold iodide, gold hydroxide, and gold oxide. These examples can be used alone or in combination of two or more. Among these examples, gold cyanide salt is particularly preferable.

The concentration of the water-soluble gold salt in the electroless gold plating bath of the present invention as gold (Au) ranges preferably from 0.00001 to 0.1 mol/L, and more preferably from 0.001 to 0.05 mol/L. The concentration less than above range may decrease a plating deposition rate and the concentration over the above range may decrease the stability of a plating bath which indicates that increasing the water-soluble gold salt amount results in little effect and losing cost benefit. The concentration is a single concentration when using a single water-soluble gold salt or a total concentration when using a combination of two or more of the water-soluble gold salts.

(3) Reducing Agent

The present invention may include any reducing agents having reduction—precipitation effect of a gold ion. Examples include the reducing agents described in Patent Document 1 (formaldehyde and/or formaldehyde bisulfite adduct, and a predetermined amine compound); the reducing agents described in Patent Document 2 (aldehyde compound and the same predetermined amine compound as in Patent Document 1); ascorbic acid; hydrazines; formic acid or its salt. In addition, the examples include the predetermined amine compound described in Patent Document 1 and Patent Document 2 and a formaldehyde precursor as a reducing agent. The kind of amine compound is not limited to the above and examples include the amine compound of formula (1) described in Patent Document 3 and the ethylenediamine derivative of formula (1) described in Patent Document 4. Referring is made to paragraphs 0048 to 0067 of Patent Document 3 for details of the amine compound described in Patent Document 3. Also, referring is made to paragraphs 0014 to 0021 of Patent Document 4 for details of the ethylenediamine derivative of the formula (1) of Patent Document 4. The above reducing agents can be used alone or in combination of two or more of the reducing agent.

The concentration of the reducing agent in the electroless gold plating bath of the present invention ranges preferably about from 0.00001 to 1 mol/L, and more preferably from 0.0001 to 0.1 mol/L. The concentration less than above range may decrease a plating deposition rate and the concentration over the above range may decrease plating bath stability which indicates that increasing the water-soluble gold salt amount results in little effect and losing cost benefit. The concentration is a single concentration when using a single reducing agent or a total concentration when using a combination of two or more of the reducing agents.

Examples of the hydrazines usable for the present invention include hydrazine; hydrazine hydrates such as hydrazine monohydrate; hydrazine salts such as hydrazine carbonate, hydrazine sulfate, hydrazine sulfate, and hydrazine hydrochloride; hydrazines organic derivatives such as pyrazoles, triazoles, and hydrazides. The pyrazoles include pyrazole; pyrazole derivatives such as 3,5-dimethylpyrazole and 3-methyl-5-pyrazolone. The triazoles include 4-amino-1,2,4-triazole, 1,2,3-triazole and the other triazoles. The hydrazides include adipic acid dihydrazide, maleic hydrazide, carbohydrazide and other hydrazines. These hydrazines can be used alone or in combination of two or more. Preferred are hydrazine hydrate such as hydrazine monohydrate, and hydrazine sulfate. These hydrazines may be used alone or in combination of two or more.

Examples of the formic acid salts include alkali metal salts of formic acid such as potassium formate and sodium formate; alkaline earth metal salts of formic acid such as magnesium formate and calcium formate; amine salts of formic acid such as ammonium salts of formic acid, quaternary ammonium salts of formic acid, amine salt containing primary to tertiary amine of formic acid. These formic acid salts may be used alone or in combination of two or more.

The present invention preferably uses the reducing agent described in Patent Document 1 and Patent Document 2, and also the reducing agent composed of a combination of the predetermined amine compound and the formaldehyde precursor described in Patent Document 1 and Patent Document 2.

(3-1) Reducing Agent Described in Patent Document 1

The reducing agent described in Patent Document 1 is formaldehyde and/or formaldehyde bisulfite adduct, and an amine compound represented by the following general formula (1) or general formula (2). Formaldehyde and/or formaldehyde bisulfite adduct alone does not act as a reducing agent, but exhibits a reducing action when used in combination with the following amine compound.

$$R_1—NH—C_2H_4—NH—R_2 \quad (1)$$

$$R_3—(CH_2—NH—C_2H_4—NH—CH_2)n—R_4 \quad (2)$$

(In the formula (1) and the formula (2), $R_1$, $R_2$, $R_3$ and $R_4$ represent —OH, —$CH_3$, —$CH_2OH$, —$C_2H_4OH$, —$CH_2N(CH_3)_2$, —$CH_2NH(CH_2OH)$, —$CH_2NH(C_2H_4OH)$, —$C_2H_4NH(CH_2OH)$, —$C_2H_4NH(C_2H_4OH)$, —$CH_2N(CH_2OH)_2$, —$CH_2N(C_2H_4OH)_2$, —$C_2H_4N(CH_2OH)_2$ or —$C_2H_4N(C_2H_4OH)_2$, and $R_1$, $R_2$, $R_3$ and $R_4$ may represent the same or different, and n is an integer of 1 to 4).

Specific examples of the formaldehyde bisulfite adduct include sodium formaldehyde bisulfite, potassium formaldehyde bisulfite, and ammonium formaldehyde bisulfite.

The concentration of the formaldehyde and/or formaldehyde bisulfite adduct in the electroless gold plating bath of the present invention ranges preferably from 0.0001 to 0.5 mol/L, more preferably 0.001 to 0.3 mol/L. The concentration less than above range may corrode underlying metal and the concentration over the above range may decrease plating bath stability.

The concentration of the amine compound of the above formula (1) or formula (2) in the electroless gold plating bath of the present invention ranges preferably from 0.001 to 1 mol/L, and more preferably from 0.01 to 0.5 mol/L. The concentration less than above range may decrease a plating deposition rate and the concentration over the above range may decrease the stability of a plating bath.

The molar ratio of each content of the above-mentioned formaldehyde and/or formaldehyde bisulfite adduct, and the amine compound of the above formula (1) or formula (2) includes; [formaldehyde and/or formaldehyde bisulfite adduct]: [the amine compound of the above formula (1) or (2)] ranges preferably from 1:30 to 3:1, more preferably from 1:10 to 1:1. The molar ratio of the formaldehyde and/or formaldehyde bisulfite adduct exceeding the above range may decrease plating bath stability and the molar ratio of the amine compound of the above formula (1) or formula (2) exceeding the above range may results in saturated effect and losing cost benefit.

(3-2) Reducing Agent Described in Patent Document 2

The reducing agent described in Patent Document 2 is an aldehyde compound and an amine compound represented by the general formula (1) or formula (2). The use of the aldehyde compound with the amino compound yields a reducing effect otherwise exhibits no effect as a reducing agent.

Examples of the aldehyde compounds include aliphatic saturated aldehydes such as formaldehyde, acetaldehyde, propionaldehyde, n-butyraldehyde, α-methylvaleraldehyde, ß-methylvaleraldehyde, and y-methylvaleraldehyde; aliphatic dialdehydes such as glyoxal and succindialdehyde; aliphatic unsaturated aldehydes such as crotonaldehyde; Aromatic aldehydes such as benzaldehyde, o-nitrobenzaldehyde, m-nitrobenzaldehyde, p-nitrobenzaldehyde, o-tolualdehyde, m-tolualdehyde, p-tolualdehyde, o-hydroxybenzaldehyde, m-hydroxybenzaldehyde, p-hydroxybenzaldehyde, phenylacetaldehyde; saccharides having an aldehyde group (—CHO) such as glucose, galactose, mannose, ribose, maltose, and lactose. Among them, formaldehyde is particularly preferable.

The concentration of the aldehyde compound in the electroless gold plating bath of the present invention ranges preferably from 0.0001 to 0.5 mol/L, and more preferably from 0.001 to 0.3 mol/L. The concentration less than above range may decrease a plating deposition rate and the concentration over the above range may decrease plating bath stability.

The molar ratio of each content of the above-mentioned aldehyde compound and the amine compound of the above formula (1) or formula (2) includes; [the aldehyde compound]: [the amine compound] ranges preferably from 1:30 to 3:1, more preferably from 1:10 to 1:1. The molar ratio of the aldehyde compound exceeding the above range may decrease plating bath stability and the molar ratio of the amine compound of the above formula (1) or formula (2) exceeding the above range may result in saturated effect and losing cost benefit.

(3-3) A Reducing Agent Comprising a Combination of the Amine Compound and the Formaldehyde Precursor Described in Patent Document 1 and Patent Document 2.

The reducing agent is composed of the formaldehyde precursor and the amine compound represented by the general formula (1) or formula (2). The use of the formaldehyde precursor with the amino compound yields a reducing effect otherwise exhibit no effect as a reducing agent.

In the present invention, "formaldehyde precursor" means a compound being decomposed in an aqueous plating bath and thereby forms formaldehyde. Examples of the formaldehyde precursor include acetal, hemiacetal, aminal and N, O-acetal.

Examples of acetal, hemiacetal, aminal and N, O-acetal are, dimethylol glycol, sodium hydroxymethylglycinate, 1,3-bis (hydroxymethyl) 5,5-dimethylimidazolidine-2, 4-dione, 1,3,5,7-tetraazatricyclo-[3.3.1.13,7] decane, benzyl hemiformal, 2-bromo-2-nitropropane-1,3-diol, 5-bromo-5-nitro-1,3-dioxane, 1,3-bis (hydroxymethyl)-1-(1,3,4-tris (hydroxymethyl)-2,5-dioxoimidazolidine-4-yl) urea, 1,1'-methylenebis {3-[1-(hydroxymethyl)-2,5-dioxoimidazolidin-4-yl] urea}, 3, 5, 7-triaza-1-azoniatricyclo-[3.3.1.13,7]-decan- 1-(3-chloro-2-propenyl)-chloride, tetramethylol glycoluril, 1,3-bis (hydroxymethyl) 2-imidazolidinone, 1,3-bis (hydroxymethyl) urea, 2,2,2-trichloroethane-1,1-diol and 5,5-dimethyl-1,3-dioxane. Referring is made to, for example, Japanese Patent No. 6066131.

The concentration of the formaldehyde precursor in the electroless gold plating bath of the present invention ranges preferably from 0.0001 to 0.5 mol/L, more preferably from 0.001 to 0.3 mol/L. The concentration less than above range may corrode underlying metal and the concentration over the above range may decrease plating bath stability.

The preferred concentration of the amine compound of the above formula (1) or formula (2) in the electroless gold plating bath of the present invention is the same as the concentration of the amine compound described in Patent Document 1 and Patent Document 2.

The molar ratio of the content of the formaldehyde precursor and the amine compound of the above formula (1) or formula (2) includes; [the formaldehyde precursor]: [amine the compound] ranges preferably from 1:30 to 3:1, more preferably from 1:10 to 1:1. The molar ratio of the formaldehyde precursor exceeding the above range may decrease plating bath stability and the molar ratio of the amine compound of the above formula (1) or formula (2) exceeding the above range may result in saturated effect and losing cost benefit.

The electroless gold plating bath of the present invention contains the phosphine compound as a stabilizer and contains no cyanide compound as an additive. "The electroless gold plating bath contains no cyanide as an additive" means no additional cyanide compound as a cyan source is added to the plating bath other than a cyanide compound derived from a water-soluble gold compound such as potassium gold cyanide. It is known that the conventional plating method supplies a cyanide compound to a plating bath for preventing plating bath decomposition because a cyanide compound such as potassium cyanide added as a gold complexing agent gradually disappears during plating and resulted in plating bath decomposition. On the other hand, the present invention adds the phosphine compound capable of preventing the decomposition of gold to the plating bath and therefore, the present invention does not need to periodically add the cyanide compound during the plating operation as described, for example, in Patent Document 3 and Patent Document 4.

(4) Other

The electroless gold plating bath of the present invention contains the above-described phosphine compound, the water-soluble gold salt, and the reducing agent, and does not contain a cyanide compound as an additive. The electroless gold plating bath of the present invention can contain an additive usually used in an electroless gold plating bath as an optional component. Preferable additives are described below.

(4-1) Complexing Agent

As the complexing agent containable in the electroless gold plating bath of the present invention, a known complexing agent used in the electroless plating bath can be used. Examples include, phosphoric acid, boric acid, citric acid, gluconic acid, tartaric acid, lactic acid, malic acid, ethylenediamine, triethanolamine, ethylenediaminetetraacetic acid, nitrilotriacetic acid, diethylenetriaminepentaacetic acid, hydroxyethylethylenediaminetriacetic acid, triethylenetetraminehexaacetic acid, 1,3-propanediaminetetraacetic acid, 1,3-diamino-2-hydroxypropanetetraacetic acid, hydroxyethyliminodiacetic acid, dihydroxylglycine, glycol ether diamine tetraacetic acid, dicarboxymethyl glutamic acid, hydroxyethylidene diphosphoric acid, ethylenediaminetetra (methylene phosphoric acid), or an alkali metal thereof (examples include, sodium, potassium) salts, alkaline earth metal salts, and ammonium salts. These may be used alone or in combination of two or more.

The concentration of the above complexing agent in the electroless gold plating bath of the present invention ranges preferably from 0.001 to 1 mol/L, and more preferably from 0.01 to 0.5 mol/L. The concentration less than above range may decrease a plating deposition rate by eluted metals and the concentration over the above range may decrease plating bath stability which indicates that increasing the water-soluble gold salt amount results in saturated effect and losing cost benefit. The concentration is a single concentration when using a single reducing agent or a total concentration when using a combination of two or more of the reducing agents.

(4-2) Stabilizer

The electroless gold plating bath of the present invention may include the stabilizer used in the known electroless plating. Examples include sulfur compounds such as 2-mercaptobenzothiazole, 2-mercaptobenzimidazole, mercaptoacetic acid, mercaptosuccinic acid, thiosulfuric acid, thioglycol, thiourea, and thiomalic acid; nitrogen compounds such as benzotriazole, 1,2,4-aminotriazole. These may be used alone or in combination of two or more.

The concentration of the stabilizer in the electroless gold plating bath of the present invention ranges preferably from 0.0000001 to 0.01 mol/L, and more preferably from 0.000001 to 0.005 mol/L. The concentration less than above range may decrease plating bath stability and the concentration over the above range may decrease a plating deposition rate. The concentration is a single concentration when using a single stabilizer or a total concentration when using a combination of two or more of the stabilizers.

(4-3) Other

The electroless gold plating bath of the present invention may include, furthermore, at least one selected from the group of thallium compounds, arsenic compounds, and lead compounds. These compounds helps to increase a gold plating rate and act as a crystal modifier. Specific examples of the compound include carbonates, acetates, nitrates, sulfates, and hydrochlorides of metals such as arsenic, thallium, and lead constituting the compounds. The total concentration of the crystal modifier in the gold plating bath ranges as a metal concentration, for example, preferably from 0.0001 to 1 mmol/L, more preferably from 0.005 to 0.1 mmol/L, and further preferably from 0.01 to 0.05 mmol/L.

The pH of the electroless gold plating bath of the present invention ranges preferably from 5 to 10. The pH less than above range may decrease a plating deposition rate and the pH over the above range may decrease plating bath stability. The addition of a pH adjuster allows to adjust the pH of the electroless gold plating bath. The present invention may use any conventionally know pH adjusters for plating bath, and examples of the pH adjuster include sodium hydroxide, potassium hydroxide, ammonia, sulfuric acid, phosphoric acid, and boric acid.

The temperature, which is heating temperature, of the electroless gold plating bath of the present invention sets preferably from 40 to 90° C. The temperature less than above range may decrease a plating deposition rate and the temperature over the above range may decrease plating bath stability.

The electroless gold plating bath of the invention allows a metal surface of a substrate to be electroless plating processed by contacting the metal surface with the electroless gold plating bath of the invention. This case has made possible to form gold plating film having a thickness of 0.01 to 2 μm with the contact time of 5 to 60 minutes, for example and this case also has made possible to form gold plating film with a deposition rate of 0.002 to 0.03 μm/min.

The material of a metal surface, a metal surface to be plated, of the substrate includes copper, copper alloy, nickel, nickel alloy, palladium, palladium alloy or other metals. Examples of the nickel alloy include a nickel-phosphorus alloy and a nickel-boron alloy, and examples of the palladium alloy include a palladium-phosphorus alloy. The metal surface may be a surface of a substrate made of a metal (including alloy), or a surface of metal film formed on a substrate. The metal film may be one formed by electroplating or one formed by electroless plating. The generally used metal film may be one formed by electroless plating using nickel, nickel alloy, palladium, or palladium alloy. Also, the surface of the metal film may be a palladium or palladium alloy film formed on a nickel or nickel alloy film formed substrate for subjecting to electroless gold plating.

The electroless gold plating bath of the present invention allows to form gold plating film with the known gold plating forming method such as a method for forming gold plating film on underlying electroless nickel plating film (formed on copper) known as ENIG (Electroless Nickel Immersion Gold); a method for forming gold plating film directly on copper known as DIG (Direct Immersion Gold); a method for forming gold plating film on electroless palladium plating film formed on underlying electroless nickel plating film (formed on copper) known as ENEPIG (Electroless Nickel/Electroless Palladium/Immersion Gold). In any methods, the electroless gold plating bath of the present invention provides the gold plating film having predetermined thickness on a surface of palladium, cupper or nickel in the above range.

The electroless gold plating bath of the present invention provides satisfactory film even on a cupper underlying film surface. This film suppresses oxidation and diffusion of cupper yielding sufficient solder joint characteristics to the film. Thickening an electroless gold plating film allows the film to use for wire bonding. The plating bath of the present invention allows good gold film to deposit on palladium, and is suitable for use in lead-free solder bonding and wire bonding.

The electroless gold plating bath of the present invention and the electroless gold plating method using the same are suitable for gold plating treatment of a wiring circuit mounting portion and a terminal portion of electronic components such as printed wiring boards, ceramic substrates, semiconductor substrates, and IC packages. The present invention is suitably used for an UBM (Under Barrier Metal) forming technique for solder bonding and wire bonding (W/B) to an Al electrode or a Cu electrode on a wafer. The gold plating bath of the present invention has made possible to stably form electroless gold plating known as a part of the UBM formation technology, and thereby allowing to obtain stable film characteristics.

EXAMPLES

The present invention will be more specifically described below, by way of examples. However, the present invention is not limited by the following examples. It is naturally understood that modifications may be properly made and practiced within the scope adaptable to the gists described above and below. All of these are included in the technical scope of the present invention. In the following, "part" means "part by mass" and "%" means "mass %" unless otherwise specified.

Example 1

In Example 1, visually observed plating baths for its decomposition after short term heating with a reducing agent or without a reducing agent in the plating bath. As described above, the mixed reaction plating methods containing a reducing agent decomposes the plating bath, but the displacement plating methods without a reducing agent does not decompose the plating bath. Also, types of reducing agent may change degree of plating bath decomposition. This experiment was conducted to confirm above.

In detail, visually observed plating baths for existence of plating bath decomposition after heating the plating baths shown in Table 1 in a hot water bath at 80° C. for 8 hours.

In Table 1, Nos. 1 to 10 are examples of the present invention using the phosphine compound 1 listed in Table 2.

No. 11 is an example of the present invention using the phosphine compound 2 listed in Table 2.

No. 12 is an example of the present invention using the phosphine compound 3 listed in Table 3.

No. 13 is an example of the present invention using the phosphine compound 4 listed in Table 2.

No. 20 is a comparative example using the phosphine compound 5 listed in Table 2.

In Table 2, parenthesized parts indicate substituents. The phosphine compound 5 is an example using tris (3-hydroxypropyl) phosphine instead of the phosphine compound defined in the present invention. In Nos. 14 to 19, no phosphine compound was added.

In Table 1, amine compound 1 and amine compound 2 are amine compounds represented by Formula (1) described in Patent Document 1 and Patent Document 2, and amine compound 3 is an amine compound represented by Formula (2) described in Patent Document 1 and Patent Document 2. Amine compound 4 is N-methyl-1,3-diaminopropane contained in the amine compound represented by Formula (1) described in Patent Document 3. Amine compound 5 is N1,N2-diisopropylethane-1,2-diamine contained in the ethylenediamine derivative amine compound represented by Formula (1) described in Patent Document 4.

No. 17 in Table 1 supplied KCN to the plating solution so that the supplied amount per hour with respect to 1 L of the plating solution after heating was 15 mg/L, but other examples did not supply KCN during heating.

Table 3 shows the results.

TABLE 1

| Gold plating bath composition | | Present inventive examples | | | | | | | | | |
|---|---|---|---|---|---|---|---|---|---|---|---|
| | | 1 | 2 | 3 | 4 | 5 | 6 | 7 | 8 | 9 | 10 |
| Water-soluble gold salts | Potassium gold cyanide [mol/L] | 0.007 | 0.007 | 0.007 | 0.007 | 0.007 | 0.007 | 0.007 | 0.007 | 0.007 | 0.007 |
| | Phosphine compound 1 [mmol/L] | 0.01 | 0.01 | 0.01 | 0.01 | 0.01 | 0.01 | 0.01 | 0.01 | 0.01 | 0.01 |
| | Phosphine compound 2 [mmol/L] | | | | | | | | | | |
| | Phosphine compound 3 [mmol/L] | | | | | | | | | | |
| | Phosphine compound 4 [mmol/L] | | | | | | | | | | |
| | Phosphine compound 5 [mmol/L] | | | | | | | | | | |
| Reducing agent | Formaldehyde [mol/L] | 0.03 | 0.03 | 0.03 | | 0.03 | 0.03 | 0.03 | 0.03 | | 0.03 |
| | Formaldehyde bisulfite Na [mol/L] | 0.02 | 0.02 | | | | | | | | |
| | Amine compound 1 ($C_2H_4OH$—NH—$C_2H_4$—NH—$C_2H_4OH$) [mol/L] | 0.07 | 0.07 | 0.07 | | | | | | | 0.07 |
| | Amine compound 2 ($C_2H_5$—NH—$C_2H_4$—NH—$C_2H_4OH$) [mol/L] | | | | | 0.07 | | | | | |
| | Amine compound 3 ($(CH_3)_2NC_2H_4$—NH—$C_2H_4$—NH—$C_2H_4N(CH_3)_2$) [mol/L] | | | | | | 0.05 | | | | |
| | Amine compound 4 ($CH_3$—NH—$C_3H_6$—$NH_2$) [mol/L] | | | | | | | 0.05 | | | |
| | Amine compound 5 ($^iPr$—NH—$C_2H_4$—NH—$^iPr$) [mol/L] | | | | | | | | 0.05 | | |
| | Hydrazine monohydrate [mol/L] | | | | | | | | | 0.03 | |
| | Ascorbic acid Na [mol/L] | | | | | | | | | | 0.01 |
| Other additives | Ethylenediaminetetraacetic acid [mmol/L] | 0.03 | 0.03 | 0.03 | 0.03 | 0.03 | 0.03 | 0.03 | 0.03 | 0.03 | 0.03 |
| | Carbonic acid TI [mmol/L] | 0.02 | 0.02 | 0.02 | 0.02 | 0.02 | 0.02 | 0.02 | 0.02 | 0.02 | 0.02 |
| | pH | 6 | 7 | 8 | 7 | 6 | 6 | 6 | 6 | 8 | 8 |

| Gold plating bath composition | | Present inventive examples | | | Comparative examples | | | | | | |
|---|---|---|---|---|---|---|---|---|---|---|---|
| | | 11 | 12 | 13 | 14 | 15 | 16 | 17 | 18 | 19 | 20 |
| Water-soluble gold salts | Potassium gold cyanide [mol/L] | 0.007 | 0.007 | 0.007 | 0.007 | 0.007 | 0.007 | 0.007 | 0.007 | 0.007 | 0.007 |
| | Phosphine compound 1 [mmol/L] | | | | | | | | | | |
| | Phosphine compound 2 [mmol/L] | 0.01 | | | | | | | | | |
| | Phosphine compound 3 [mmol/L] | | 0.02 | | | | | | | | |
| | Phosphine compound 4 [mmol/L] | | | 0.02 | | | | | | | |
| | Phosphine compound 5 [mmol/L] | | | | | | | | | | |
| Reducing agent | Formaldehyde [mol/L] | | | | | | | | | | 0.02 |
| | Formaldehyde bisulfite Na [mol/L] | 0.03 | 0.03 | 0.03 | | 0.03 | | | | 0.03 | 0.03 |
| | Amine compound 1 ($C_2H_4OH$—NH—$C_2H_4$—NH—$C_2H_4OH$) [mol/L] | 0.07 | 0.07 | 0.07 | | 0.07 | 0.07 | | | 0.07 | 0.07 |
| | Amine compound 2 ($C_2H_5$—NH—$C_2H_4$—NH—$C_2H_4OH$) [mol/L] | | | | | | | | | | |
| | Amine compound 3 ($(CH_3)_2NC_2H_4$—NH—$C_2H_4$—NH—$C_2H_4N(CH_3)_2$) [mol/L] | | | | | | | | | | |

TABLE 1-continued

| | | | | | | | | | | | |
|---|---|---|---|---|---|---|---|---|---|---|---|
| | Amine compound 4 ($CH_3$—NH—$C_3H_6$—$NH_2$) [mol/L] | | | | | | | | | | |
| | Amine compound 5 ($^iPr$—NH—$C_2H_4$—NH—$^iPr$) [mol/L] | | | | | | | | | | |
| | Hydrazine monohydrate [mol/L] | | | | | | 0.03 | | | | |
| | Ascorbic acid Na [mol/L] | | | | | | | | | | |
| Other additives | Ethylenediaminetetraacetic acid [mmol/L] | 0.03 | 0.03 | 0.03 | 0.03 | 0.03 | 0.03 | 0.01 0.03 | 0.03 | 0.03 | 0.03 |
| | Carbonic acid TI [mmol/L] | 0.02 | 0.02 | 0.02 | 0.02 | 0.02 | 0.02 | 0.02 | 0.02 | 0.02 | 0.02 |
| | pH | 6 | 6 | 6 | 7 | 7 | 8 | 8 | 6 | 7 | 7 |

TABLE 2

| | $R_1$ | $R_2$ | $R_3$ |
|---|---|---|---|
| phosphine compound 1 | Phe ($SO_3Na$) | Phe ($SO_3Na$) | Phe ($SO_3Na$) |
| phosphine compound 2 | Phe ($SO_3Na$) | Phe | Phe |
| phosphine compound 3 | $CH_2CH_2$ (CN) | $CH_2CH_2$ (CN) | $CH_2CH_2$ (CN) |
| phosphine compound 4 | $CH_2CH_2$ (COOH) | $CH_2CH_2$ (COOH) | $CH_2CH_2$ (COOH) |
| phosphine compound 5 | $CH_2CH_2CH_2$ (OH) | $CH_2CH_2CH_2$ (OH) | $CH_2CH_2CH_2$ (OH) |

| | Present inventive examples | | | | | | | | | | | | | Compartive examples | | | | | | |
|---|---|---|---|---|---|---|---|---|---|---|---|---|---|---|---|---|---|---|---|---|
| Evaluation item | 1 | 2 | 3 | 4 | 5 | 6 | 7 | 8 | 9 | 10 | 11 | 12 | 13 | 14 | 15 | 16 | 17 | 18 | 19 | 20 |
| Heating temperature [° C.] | 80 | 80 | 80 | 80 | 80 | 80 | 80 | 80 | 80 | 80 | 80 | 80 | 80 | 80 | 80 | 80 | 80 | 80 | 80 | 80 |
| Heating time [hour] | 8 | 8 | 8 | 8 | 8 | 8 | 8 | 8 | 8 | 8 | 8 | 8 | 8 | 8 | 8 | 8 | 8 | 8 | 8 | 8 |
| KCN replenishment during heating | no | no | no | no | no | no | no | no | no | no | no | no | no | no | no | no | no | no | yes | no |
| Bath decomposition | no | no | no | no | no | no | no | no | no | no | no | no | no | yes | yes | no | no | no | no | no |

Table 3 indicates followings:

Example Nos. 1 to 13 in Table 1 are examples of the present invention using a reducing agent and a phosphine compound defined in the present invention. These examples contain a various kind of reducing agent. The results showed that no bath decomposition was observed because the phosphine compound prevented decomposition of the plating bath even containing any reducing agent in the plating bath.

In contrast, Comparative Example Nos. 14 and 15 in Table 1 contain a reducing agent but do not contain the phosphine compound defined in the present invention, and resulted in bath decomposition.

Comparative Examples Nos. 16 and 17 are examples using hydrazine (No. 16) and ascorbic acid (No. 17) both having a small reducing action, and resulted in no bath decomposition under short term heating condition of this experiment.

Comparative Example No. 18 contains no reducing agent, and no bath decomposition was observed.

Evaluation of the results of Example No. 2, and Comparative Example Nos. 14, 19 and 20 in Table 1 having same pH=7 and containing same type of reducing agent reveals the followings; Example No. 2 and Comparative Example No. 20 containing the phosphine compound even with any reducing agent resulted in no bath decomposition under short term heating condition of this experiment. Contrary to this, Comparative Example No. 14 containing no phosphine compound resulted in bath decomposition. Comparative Example No. 19 resulted in no bath decomposition because KCN was supplied to the plating bath during the bath heating.

Example 2

In Example 2, continuous plating was performed using some plating baths in Table 1 under following conditions, and evaluates various characteristics below.

(1) Stability Evaluation (Presence or Absence of Bath Decomposition)

First, a substrate was prepared by cutting a copper-clad laminate (MCL-E-67 manufactured by Hitachi Chemical Co., Ltd.) into a 5 cm square. The substrate was sequentially subjected to the plating steps shown in Table 4 to perform electroless Ni plating and electroless Pd plating to form Ni/Pd plating film, and then immersed in an electroless Au plating bath having the composition shown in Table 1 to continuously deposit gold on the Ni/Pd plating film. The substrate was washed between the each steps in Table 4. Visually observed the Au plating bath for its decomposition from first day to five days after heating.

A water-soluble gold salt and a reducing agent were supplied to each gold plating bath every consumption of 0.1 g/L in terms of gold during its heating. The substrate was changed every 20 minutes. During the plating process, the pH of the bath was measured every day, and the pH was adjusted as necessary so as to maintain the pH described in Table 1.

(2) Film Characteristics Evaluation

Each sample, having 5 μm thick Ni film/0.1 μm thick Pd film/0.1 μm thick Au film, was prepared in the same manner as above (1). Various film characteristics [existence of corrosion of Ni, solder joint reliability, and wire bonding (W/B) property] were evaluated for the each sample in initial make-up of an electroless bath. The film thickness was measured using a fluorescent X-ray film thickness meter (XDV-u manufactured by Fisher Instruments Co., Ltd.).

(2-1) Corrosion of Ni plating by cross-sectional SEM observation

Corrosion of Ni plating of Example Nos. 1 and 16 in Table 1 was evaluated by a SEM at 30 μm window after processing the cross section of the prepared Ni/Pd/Au plating film with a focused ion beam apparatus (manufactured by Hitachi High-Technologies Corporation). The figure at A shows Example No. 16 as comparative example, and observed corrosion. The figure at B shows Example No. 1 as inventive example, and observed no corrosion.

(2-2) Solder Joint Reliability Evaluation

The Solder joint reliability of each sample was evaluated under the following conditions. The solder joint strength was evaluated by the solder rupture rate in the fracture mode. The solder joint reliability having the solder rupture rate of 85% or more is evaluated as "good", and the solder rupture rate of less than 85% is evaluated as "poor".

(Measurement Condition)

Measuring method: Ball pull test

Solder ball: SAC305 (φ0.6 mm) manufactured by Senju Metal Industry

Reflow device: ANTOM-made UNI-6116a

Reflow conditions: Top 260° C.

Reflow environment: Air

Reflow times: 5 times

Flux: 529D-1 (RMA type) made by Senju Metal

Test speed: 5000 μm/sec

Aging after solder mounting: 1 hour

Evaluation board: BGA board (Ball Grid Array: manufactured by C. Uyemura Co., Ltd., 5 cm×5 cm, φ0.5 mm)

(2-3) Wire Bonding (W/B) Evaluation

Each sample in initial make-up of an electroless bath formed wire bonding using a semi-automatic wire bonder HB16 manufactured by TPT, and 20 points were evaluated per condition using a bond tester SERIES 4000 manufactured by Dage. In details, 20 points of wire bonding strength (W/B strength) were measured using some gold plating bath in Table 1, and the average value of W/B average strength and standard deviation were calculated. Furthermore, the coefficient of variation (=standard deviation/average value×100) was determined based on the calculated values. The conditions for forming the wire bonding and for evaluating the wire bonding property are as follows. The wire bonding property having the W/B average strength of 8 gf or more and the variation coefficient of 15% or less is evaluated as "good", and at least one of the W/B average strength and the variation coefficient falls outside of the above range is evaluated as "poor".

[Conditions for Wire Bonding Formation and Wire Bonding Evaluation]

Capillary: B1014-51-18-12 (PECO)

Wire: 1 Mil-Gold

Stage temperature: 150° C.

Heat treatment conditions: 175° C., 16 hr

Ultrasonic wave (mW): 250 (1st), 250 (2nd)

Bonding time: (milliseconds): 200 (1st), 50 (2nd)

Tensile force (gf): 25 (1st), 50 (2nd)

Step (length from 1st to 2nd): 0.700 mm

Measurement method: Wire pull test Test speed: 170 μm/sec (3) Measurement of Deposition Rate A plating deposition rate (μm/20 min) of gold plating film formed by plating at 80° C. for 20 minutes after preparing each sample having a Ni/Pd/Au plating film in the same manner as (1) above. The deposition rate was measured by using a fluorescent X-ray film thickness meter (XDV-u manufactured by Fischer Instruments Co., Ltd.).

These results are shown in Table 5. Each No. in Table 5 corresponds to each No. in Table 1.

TABLE 4

| Plating steps | | Temperature [° C.] | Time [min] |
|---|---|---|---|
| Cleaner | ACL-007 manufactured by C. Uyemura & Co., Ltd. | 50 | 5 |
| Hot water washing | Hot ion exchange water | 50 | 1 |
| Soft etching | Persulfate Na 100 g/L Sulfuric acid 20 g/L | 25 | 1 |
| Acid cleaning | Sulfuric acid 50 g/L | 25 | 1 |
| Electroless nickel plating | NPR-4 manufactured by C. Uyemura & Co., Ltd. | 80 | 25 |
| Electroless palladium plating | TPD-30 manufactured by C. Uyemura & Co., Ltd. | 50 | 4 |
| Electroless gold plating | see Table 1 | 80 | see Table 5 (days) |

TABLE 5

| Evaluation item | | Present inventive examples | | | | | | Comparative examples | | |
|---|---|---|---|---|---|---|---|---|---|---|
| | | 2 | 4 | 9 | 11 | 12 | 13 | 14 | 15 | 16 |
| Bath decomposition | Day one | no | no | no | no | no | no | yes | yes | no |
| | Day two | no | no | no | no | no | no | yes | yes | no |
| | Day three | no | no | no | no | no | no | yes | yes | yes |
| | Day four | no | no | no | no | no | no | yes | yes | yes |
| | Day five | no | no | no | no | no | no | yes | yes | yes |
| KCN replenishment | | no | no | no | no | no | no | no | no | no |
| Ni corrosion | | no | no | no | no | no | no | no | no | no |
| Solder joint reliability | Evaluation | good | good | good | good | good | good | good | good | good |
| | Solder breaking rate | 100 | 100 | 90 | 90 | 95 | 100 | 100 | 100 | 90 |
| W/B properties | Evaluation | good | good | good | good | good | good | good | good | good |
| | Average strength [gF] | 9.5 | 8.8 | 8.7 | 8.8 | 9.0 | 9.1 | 9.2 | 8.7 | 8.5 |
| | Coefficient of variation [%] | 9 | 12 | 9 | 11 | 9 | 10 | 10 | 12 | 11 |
| Heating temperature [° C.] | | 80 | 80 | 80 | 80 | 80 | 80 | 80 | 80 | 80 |
| Deposition rate [um/20 min] | | 0.14 | 0.12 | 0.07 | 0.07 | 0.07 | 0.12 | 0.14 | 0.13 | 0.07 |

TABLE 5-continued

| Evaluation item | | Comparative examples 17 | 18 | 19 | 20 |
|---|---|---|---|---|---|
| Bath decomposition | Day one | no | no | no | no |
| | Day two | no | no | no | yes |
| | Day three | yes | no | no | yes |
| | Day four | yes | no | no | yes |
| | Day five | yes | no | no | yes |
| KCN replenishment | | no | no | yes | no |
| Ni corrosion | | no | yes | no | no |
| Solder joint reliability | Evaluation | good | poor | good | good |
| | Solder breaking rate | 85 | 40 | 100 | 95 |
| W/B properties | Evaluation | good | poor | good | good |
| | Average strength [gF] | 8.2 | 6.4 | 8.0 | 9.2 |
| | Coefficient of variation [%] | 13 | 21 | 12 | 8 |
| Heating temperature [° C.] | | 80 | 80 | 80 | 80 |
| Deposition rate [um/20 min] | | 0.07 | 0.07 | 0.14 | 0.02 |

From Table 5 indicates followings:

Example Nos. 2, 4, 9, 11, 12, and 13 are examples of the present invention using a reducing agent and a phosphine compound defined in the present invention. The results showed that a preferable deposition rate was maintained without plating bath decomposition during long term plating bath heating because the phosphine compound prevented decomposition of the plating bath. Also no Ni corrosion was observed thereby these examples are evaluated as good in Solder joint reliability and wire/bonding (IV/B) properties.

In contrast, Comparative Example Nos. 14 and 15 in Table 1 contained a reducing agent but did not contain the phosphine compound defined in the present invention, and resulted in bath decomposition. Also Comparative Examples No. 14 and 15 (further more Comparative Example Nos. 16, 17 19, and 20) containing the reducing agent showed no Ni corrosion thereby Solder joint reliability and wire/bonding properties were good.

Comparative Examples Nos. 16 and 17 are examples using hydrazine (No. 16) and ascorbic acid (No. 17) both having a small reducing action, and resulted in observing bath decomposition on and after the third day after heating the bath under long term heating condition of this experiment.

Comparative Example No. 18 contained no reducing agent, and observed no bath decomposition but observed Ni corrosion thereby Solder joint reliability and W/B property were decreased.

Comparative Example No. 20 used the phosphine compound outside the scope of the present invention, and observed bath decomposition remarkably on the second day after heating the bath. Further, this Example resulted in significant decrease in the plating deposition rate.

Comparative Example No. 19 resulted in no bath decomposition because KCN was supplied to the plating bath during the bath heating.

These results showed that the phosphine compound used in the present invention exhibits useful effect for preventing a plating bath decomposition even under long term continuous plating bath heating, and contributes greatly to improve plating bath stability by maintaining high plating deposition rate. And the present invention achieves above effect without adding a toxic cyanide compound as an additive, and therefore, the present invention has advantages in work efficiency and work environment.

The invention claimed is:

1. An electroless gold plating bath, comprising:

a water-soluble gold salt;

a reducing agent; and a phosphine compound represented by a following formula (1)

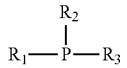

(1)

wherein $R_1$, $R_2$, and $R_3$ represent identically or differently either a phenyl group, or an alkyl group having 1 to 5 carbons, and at least one of the phenyl group or the alkyl group is substituted by a sulfonate group or its salt, a cyano group, or a carboxy group or its salt.

2. The electroless gold plating bath according to claim 1, wherein the electroless gold plating bath contains no cyanide compound as an additive.

3. The electroless gold plating bath according to claim 1, wherein the electroless gold plating bath has a pH of 5 to 10.

4. The electroless gold plating bath according to claim 1, wherein the reducing agent is formaldehyde and/or formaldehyde bisulfate adduct in combination with at least one of the following amine compounds $$R_1—NH—C_2H_4—NH—R_2 \quad (1)$$

$$R_3—(CH_2—NH—C_2H_4—NH—CH_2)n—R_4 \quad (2)$$

wherein in (1) and the formula (2), $R_1$, $R_2$, $R_3$ and $R_4$ represent —OH, —$CH_3$, —$CH_2OH$, —$C_2H_4OH$, —$CH_2N(CH_3)_2$, —$CH_2NH(CH_2OH)$, —$CH_2NH(C_2H_4OH)$, —$C_2H_4NH(CH_2OH)$, —$C_2H_4NH(C_2H_4OH)$, —$CH_2N(CH_2OH)_2$, —$CH_2N(C_2H_4OH)_2$, —$C_2H_4N(CH_2OH)_2$ or —$C_2H_4N(C_2H_4OH)_2$, $R_1$, $R_2$, $R_3$ and $R_4$ may represent are the same or are different, and n is an integer of 1 to 4.

5. The electroless gold plating bath according to claim 1, wherein the water-soluble gold salt is gold cyanide salt and/or gold cyanide.

* * * * *